United States Patent [19]

Moughty et al.

[11] 4,079,965

[45] Mar. 21, 1978

[54] VACUUM CLEANER WAND

[75] Inventors: John J. Moughty, Old Greenwich; John T. Ferraris, Stamford; William P. Ritzau, Old Greenwich; J. Fred Collins, Cos Cob, all of Conn.

[73] Assignee: Consolidated Foods Corporation, Old Greenwich, Conn.

[21] Appl. No.: 737,465

[22] Filed: Nov. 1, 1976

[51] Int. Cl.[2] ..... A47L 9/24

[52] U.S. Cl. ..... 285/7; 174/47; 285/119; 285/319; 339/16 R; 403/108; 403/109

[58] Field of Search ..... 285/7, 317, 119; 15/377; 174/47; 339/16 R

[56] References Cited

U.S. PATENT DOCUMENTS

| | | | |
|---|---|---|---|
| 2,212,679 | 8/1940 | White | 285/317 X |
| 2,727,762 | 12/1955 | Ziegler, Jr. | 285/7 |
| 2,793,055 | 5/1957 | Meyerhoefer | 285/7 |
| 2,829,190 | 4/1958 | Comlossy, Jr. | 174/47 |
| 2,885,223 | 5/1959 | Duff | 285/7 |
| 3,553,629 | 1/1971 | Brown et al. | 174/47 X |
| 3,815,170 | 6/1974 | Brooks et al. | 15/377 X |
| 3,961,647 | 6/1976 | Doubleday | 174/47 X |
| 4,012,091 | 3/1977 | Westergren | 285/7 X |

*Primary Examiner*—Werner H. Schroeder
*Assistant Examiner*—Conrad L. Berman
*Attorney, Agent, or Firm*—William S. Henry

[57] ABSTRACT

In accordance with the present invention, there is provided an improved wand for connecting a vacuum cleaner suction nozzle having an electric motor therein to a suction hose. A wand of this type normally serves as both a rigid handle for manipulating the nozzle and as a conduit for the passage of air from the nozzle to the hose. In addition, the present wand is provided with a sheath of preferably electrical insulating material for retaining an electric cord for supplying current to the motor in the nozzle from conductors carried by the suction hose.

4 Claims, 8 Drawing Figures

FIG. 1
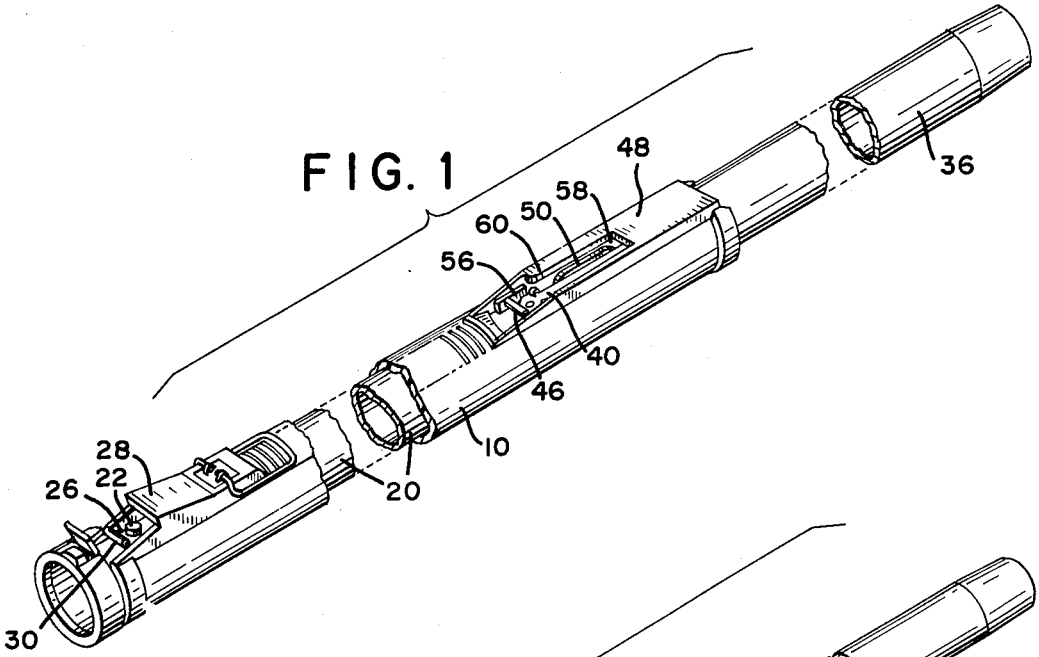
FIG. 2
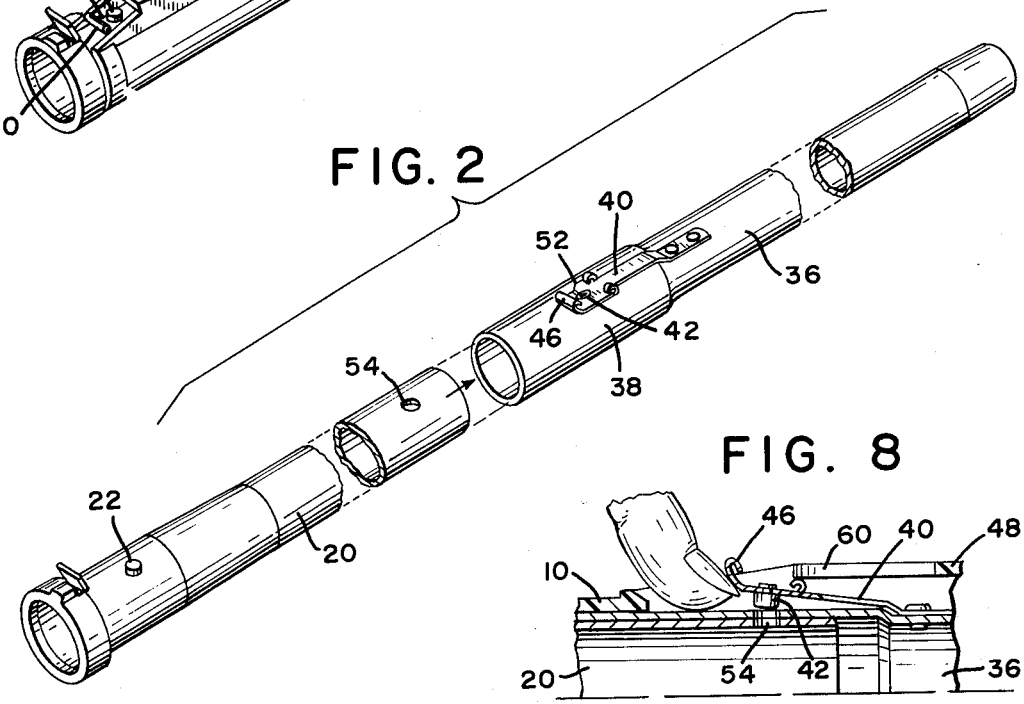
FIG. 8
FIG. 3
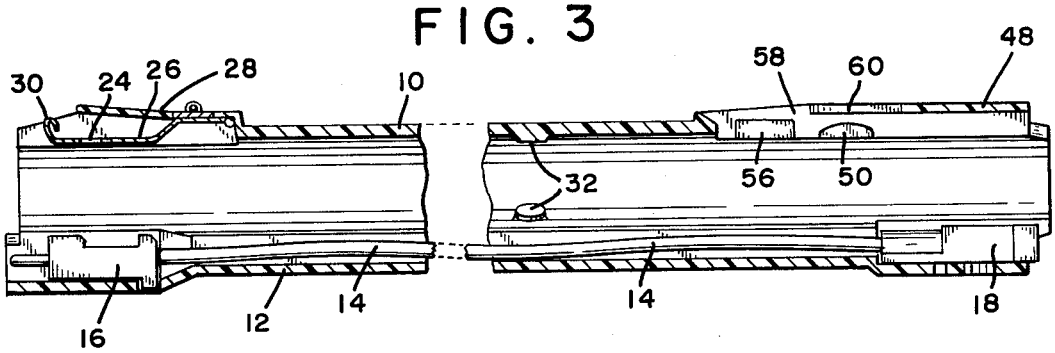

VACUUM CLEANER WAND

BACKGROUND OF THE INVENTION

Particularly for convenience in packing in a carton with the other parts of a vacuum cleaner, it is desirable to have the wand made so that it comes apart in the middle. Heretofore, with wands provided with a sheath for electrical conductors, the sheath has presented difficulties in providing a coupling between the two parts of the wand which may be quickly and easily released but which assures a firm and secure connection.

SUMMARY OF THE INVENTION

The invention involves a pair of tubular conduits, one of which is insertable into one end of a tubular sheath and extends to adjacent the other end thereof and may be removably secured therein, although normally it is not necessary to remove it. The other conduit is insertable into the opposite end of the sheath to be detachably coupled to the adjacent end of the first conduit, and the sheath is formed with an aperture in the region of the coupling to give access to manually operable means for releasing the latter.

DESCRIPTION OF THE FIGURES

FIG. 1 is a prospective view of the complete wand, including one conduit within the sheath and the other conduit coupled to the first;

FIG. 2 is a prospective view with the sheath removed and the two conduits uncoupled from each other;

FIG. 3 is a longitudinal cross-sectional view of the sheath;

FIG. 8 is a cross-sectional view similar to FIG. 6, but showing a latch member displaced by the operator's thumb.

Figure 4:
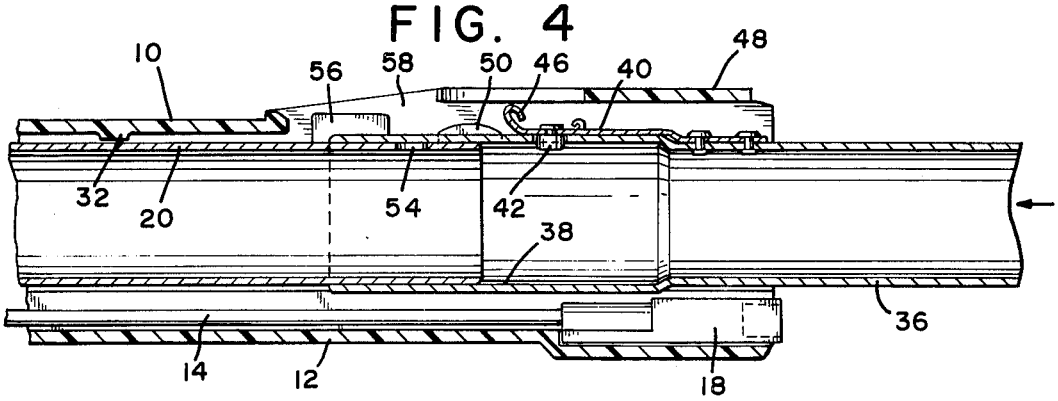
FIG. 4 is a longitudinal cross-sectional view of the central portion of the wand with the sheath in place on one conduit and the other conduit partially engaged with the first.

Referring to the drawings, reference character 10 designates a tubular sheath generally cylindrical in cross-section, but formed with a channel 12 extending longitudinally thereof. An electric cord 14 is received within the channel and has a male plug 16 at one end thereof and a female receptacle 18 at the other. Received within sheath 10 is a tubular conduit 20 which is removably retained therein by the engagement of a detent 22 engaging a recess 24 formed in a resilient strip 26 secured to the sheath within an enlarged end 28 thereof.

Conduit 20 may be removed from the sheath by lifting the end 30 of strip 26, but in normal use it is not necessary to do so. The outside diameter of conduit 20 is slightly less than the inside diameter of sheath 10 and at the right hand end of the latter, as viewed in the drawings, an annular ring or three or more equally spaced projections 32 are provided in the sheath so as to center the conduit 20 therein and thus provide an annular space 34 therebetween.

A second tubular conduit 36 is formed with a slightly enlarged end portion 38 having an inner diameter substantially equal to the outer diameter of conduit 20 and an outer diameter substantially equal to the inner diameter of sheath 10. A resilient locking member 40 is secured to the outside of conduit 36 and has a projection or detent 42 which is urged through an opening 44 formed in the enlarged portion 38. The free end of member 40 is a curled up extension 46 which may be engaged by the operator's thumb, as will be later explained and as shown in FIG. 8.

Figure 5:
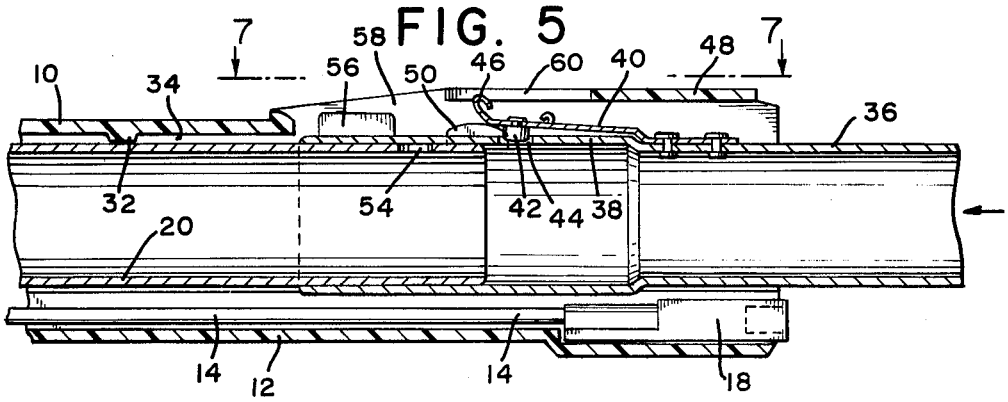
FIG. 5 is a view similar to FIG. 4, but with the other conduit more fully engaged with the first.
Figure 7:
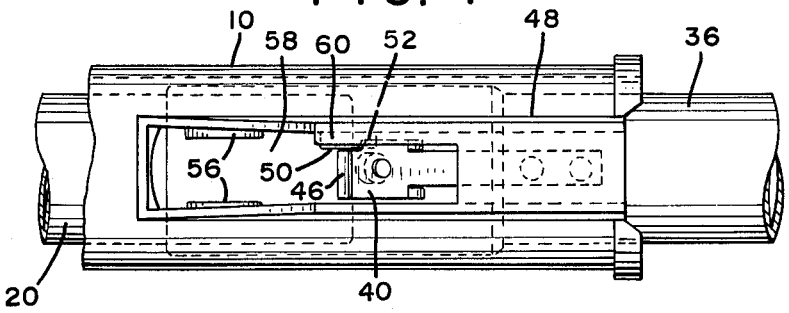
FIG. 7 is a top view of FIG. 5.

The right hand end of sheath 10 has an enlarged portion 48 on the opposite side of the sheath from channel 12. When it is desired to couple conduit 36 to conduit 20, the enlarged end 38 of the former is introduced into the right end of sheath 10 so as to telescope over the adjacent end of conduit 20, strip 40 with extension 46 entering enlarged portion 48 of the sheath, as shown in FIG. 4. It will be noted that detent 42 extends through opening 44 far enough to be in line with the end of conduit 20. However, a cam 50 is formed on sheath 10 within and at one side of the enlarged portion 48 and so positioned that, as conduit 36 is moved further to the left, as shown in FIG. 5, a side projection 52, shown in FIG. 7, on resilient locking member 40 rides up on the cam so as to lift the locking member and withdraw detent 42 sufficiently to clear the end of conduit 20.

Further movement of conduit 36 to the left causes projection 52 to pass beyond cam 50, thus permitting detent 42 to enter a recess 54 formed in the wall of conduit 20 to thereby lock the two conduits together. In this position the end of the enlarged portion 38 of conduit 36 is received in the annular space 34 between conduit 20 and the sheath. The sides of enlarged portion 48, inwardly from cam 50, are formed with abutting surfaces 56 between which is received the free end of locking member 40 so as to restrain the locked conduits from any tendency to rotate within the sheath.

Figure 6:
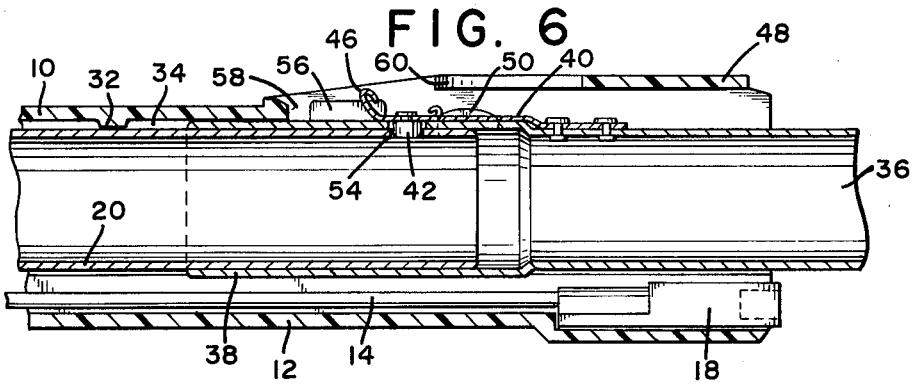
FIG. 6 is a view similar to FIGS. 4 and 5, but with the other conduit in full engagement with the first.

The top of enlarged portion 48 is formed with an aperture 58 through which the curled end 46 of locking member 40 is accessible when the conduits are locked together, as shown in FIG. 6, so that end 46 may be manually raised conveniently by the thumb as shown in FIG. 8, so as to release detent 42 from engagement with recess 54 to thus permit withdrawal of conduit 36 from telescopic engagement with conduit 20. A projecting ledge 60 extends inwardly from an upper edge of aperture 58 so as to extend over projection 52 on locking member 40 in order to prevent bending of the locking member so as to permanently deform it by the application of an undue lifting force.

While there has been shown a more or less specific embodiment of the invention, it is to be understood that this has been done for purposes of illustration only, and that the scope of the invention is to be determined from the appended claims.

We claim:

1. In a wand for a vacuum cleaner, a tubular sheath formed with a channel extending lengthwise along one exterior side thereof, electric conductors disposed in said channel, a first tubular conduit insertable axially into said sheath from one end thereof and extending therein to adjacent the opposite end of said sheath, a second tubular conduit insertable axially into said opposite end of said sheath for telescopic engagement within said sheath with the adjacent end of said first tubular conduit, releasable locking means carried by one of said tubular conduits in the region of the telescopic engagement and engageable with the other of said tubular conduits for coupling said conduits together, said sheath being formed with an aperture through the side thereof in said region of the telescopic engagement, and manually operable means accessible through said aperture for releasing said locking means.

2. A wand as described in claim 1 in which said first conduit is telescopically received within said second conduit and is formed with a recess in the portion thereof which is received within said second conduit, said locking means comprising a spring-loaded detent carried by said second conduit engageable with said recess to lock said conduits together, and a finger-operable member accessible through said aperture for disengaging said detent from said recess.

3. A wand as described in claim 2 in which said detent is mounted on a resilient arm secured on the exterior of said second conduit, said detent being urged by said arm inwardly through an opening in said second conduit to engage said recess, and a cam surface formed on said sheath to be engaged by said arm for moving said detent outwardly through said opening as said second conduit is inserted into said opposite end of said sheath to cause said detent to clear the end of said first conduit.

4. A wand as described in claim 2 in which said detent is mounted on a resilient arm secured on the exterior of said second conduit, said detent being urged by said arm inwardly through an opening in said second conduit to engage said recess, said arm being accessible through said aperture for lifting movement by the finger to release said detent from said recess, and means on said sheath for limiting the extent of said movement.

* * * * *